US011183316B2

(12) United States Patent
Angermann et al.

(10) Patent No.: US 11,183,316 B2
(45) Date of Patent: Nov. 23, 2021

(54) METHOD FOR PRODUCING A CABLE CORE FOR A CABLE, IN PARTICULAR FOR AN INDUCTION CABLE

(71) Applicant: LEONI KABEL GMBH, Roth (DE)

(72) Inventors: Gerhard Angermann, Georgensgmuend (DE); Klaus Bitterwolf, Spalt (DE); Thomas Brunner, Schwabach (DE); Michael Dreiner, Wipperfuerth (DE); Christian Eck, Wipperfuerth (DE); Jan Foerster, Wipperfuerth (DE); Sebastian Goss, Roth (DE); Jens Mosebach, Wipperfuerth (DE); Ulrich Raupach, Bamberg (DE); Rainer Sessner, Roth (DE)

(73) Assignee: LEONI Kabel GmbH, Roth (DE)

( * ) Notice: Subject to any disclaimer, the term of this patent is extended or adjusted under 35 U.S.C. 154(b) by 237 days.

(21) Appl. No.: 16/257,644

(22) Filed: Jan. 25, 2019

(65) Prior Publication Data

US 2019/0156969 A1 May 23, 2019

Related U.S. Application Data

(60) Division of application No. 15/250,254, filed on Aug. 29, 2016, which is a continuation of application No. PCT/EP2015/054184, filed on Feb. 27, 2015.

(30) Foreign Application Priority Data

Feb. 28, 2014 (DE) ..... 10 2014 203 775.1

(51) Int. Cl.
*H01R 43/00* (2006.01)
*H01B 7/00* (2006.01)
(Continued)

(52) U.S. Cl.
CPC ..... *H01B 7/0054* (2013.01); *E21B 43/2401* (2013.01); *H01B 3/427* (2013.01);
(Continued)

(58) Field of Classification Search
CPC .. H01B 7/0009; H01B 7/0054; H01B 7/0216; H01B 7/0892; H01B 7/1815;
(Continued)

(56) References Cited

U.S. PATENT DOCUMENTS 3,676,769 A * 7/1972 Loepfe ..... G01P 13/00 324/454
6,680,465 B2 * 1/2004 O'Connor ..... H01B 7/292 219/544
(Continued)

FOREIGN PATENT DOCUMENTS

CN 1667897 9/2005 ..... H02G 1/14
DE 102009042127 A1 3/2011
(Continued)

*Primary Examiner* — Paul D Kim
(74) *Attorney, Agent, or Firm* — Laurence A. Greenberg; Werner H. Stemer; Ralph E. Locher

(57) ABSTRACT

A cable core for a cable, in particular, for an induction cable that includes multiple such cable cores which have a conductor that is interrupted in the longitudinal direction at specified longitudinal positions at multiple separation points, thereby forming two conductor ends. An insulating intermediate piece is provided for connecting the conductor ends, and the conductor ends are arranged on both sides of the intermediate piece. The conductor and the intermediate piece are surrounded together by a continuous insulating jacket in order to form the cable core. In a preferred concept, a respective intermediate piece is arranged between the two conductor ends by two adapter elements. In another preferred concept, a respective intermediate piece, in particular, a ceramic intermediate piece, is connected directly to two
(Continued)

conductor ends. A cable is formed from a plurality of such cable cores.

20 Claims, 5 Drawing Sheets

(51) Int. Cl.

| | |
|---|---|
| ***E21B 43/24*** | (2006.01) |
| ***H05B 6/10*** | (2006.01) |
| ***H01B 3/42*** | (2006.01) |
| ***H01B 7/02*** | (2006.01) |
| ***H01B 7/08*** | (2006.01) |
| ***H01B 7/18*** | (2006.01) |
| ***H01B 13/14*** | (2006.01) |
| ***H01B 13/22*** | (2006.01) |

(52) U.S. Cl.
CPC ..... *H01B 7/0009* (2013.01); *H01B 7/0216* (2013.01); *H01B 7/0892* (2013.01); *H01B 7/1815* (2013.01); *H01B 13/14* (2013.01); *H01B 13/22* (2013.01); *H05B 6/108* (2013.01); *H05B 2214/03* (2013.01)

(58) Field of Classification Search
CPC ..... H01B 3/427; H01B 13/14; H01B 13/22; E21B 43/2401; H05B 2214/03; H05B 6/108
See application file for complete search history.

(56) References Cited

U.S. PATENT DOCUMENTS

| | | | | |
|---|---|---|---|---|
| 8,076,408 | B2 * | 12/2011 | Nakamura | H01B 3/20 524/515 |
| 8,766,146 | B2 | 7/2014 | Diehl | |
| 10,219,326 | B2 * | 2/2019 | Mosebach | H01B 7/0009 |
| 2010/0059247 | A1 * | 3/2010 | de Oliveira Lima | H01B 7/0072 174/103 |
| 2011/0006055 | A1 | 1/2011 | Diehl | E21B 36/04 219/600 |
| 2011/0226507 | A1 | 9/2011 | Ueda | H01B 11/1817 174/106 R |
| 2012/0181858 | A1 * | 7/2012 | Hellinger | H01F 38/14 307/9.1 |
| 2014/0238968 | A1 | 8/2014 | Lee | H05B 3/565 219/209 |
| 2014/0263289 | A1 | 9/2014 | Mosebach et al. | |
| 2014/0301017 | A1 | 10/2014 | Diehl et al. | |

FOREIGN PATENT DOCUMENTS

| | | |
|---|---|---|
| EP | 2250858 | 8/2011 |
| WO | 2013060610 A1 | 5/2013 |
| WO | 2013079201 A1 | 6/2013 |

* cited by examiner

METHOD FOR PRODUCING A CABLE CORE FOR A CABLE, IN PARTICULAR FOR AN INDUCTION CABLE

CROSS-REFERENCE TO RELATED APPLICATION

This is a divisional of patent application Ser. No. 15/250,254, filed Aug. 29, 2016; which was a continuation, under 35 U.S.C. § 120, of International application No. PCT/EP2015/054184, filed Feb. 27, 2015; this application also claims the priority, under 35 U.S.C. § 119, of German patent application No. DE 10 2014 203 775.1, filed Feb. 28, 2014; the prior applications are herewith incorporated by reference in their entirety.

BACKGROUND OF THE INVENTION

Field of the Invention

The invention relates to a cable core for a cable, in particular for an induction cable, having a plurality of such cable cores which each have a conductor which is interrupted at a plurality of separation points at predetermined longitudinal positions in the longitudinal direction, forming two conductor ends. In order to connect the conductor ends, an insulating intermediate piece is provided, on both sides of which the conductor ends are arranged. Furthermore, the invention relates to a cable having a plurality of such cable cores, and to a method for producing a cable core for a cable.

Such a cable serves in particular for use as what is known as an induction cable (alternatively also called an inductor) to form one or more induction fields. The cable is in this case provided in particular for the inductive heating of oil sand deposits and/or extra-heavy oil deposits. Such an application of an induction cable of this type can be found for example in European patent EP 2 250 858 B1. The technical boundary conditions that result from this application are met by the cable described in the following text.

In order to establish the induction fields and to realize the inductive heating, it is necessary for the individual cable cores of the cable to be separated at defined separation points into a contact spacing with a defined length of for example several tens of meters. Each of the cable cores is in this case subdivided into a number of core sections by the separation points.

Within the cable, a plurality of cable cores are combined preferably to form core groups, wherein the separation points or interruptions of the cores of each particular core group are located substantially at the same longitudinal position. Typically, there are two core groups, the separation points of which are displaced by half the contact spacing relative to one another. In other words, the separation points of a first core group are arranged half way between two separation points of a second core group in the longitudinal direction. This results in an overlap of the core sections of different groups, which serves in particular to form an induction cable.

Such a cable is described for example in international patent disclosure WO 2013 079 201 A1, corresponding to U.S. patent publication No. 2014/0263289. The document discloses a cable core for a cable, in particular for an induction cable, having a plurality of such cable cores which each have a conductor surrounded by insulation. Furthermore, each particular cable core, i.e. a conductor surrounded by an insulating sheath, is interrupted at separation points at predetermined longitudinal positions in the cable longitudinal direction, forming two core ends. In order to connect these, a connector having an insulating intermediate piece is arranged and the core ends are fastened to the connector on both sides of the intermediate piece. In order to connect the core ends, the connector is formed in a sleeve-like manner at its opposite ends, such that each particular core end, that is to say in particular also a part of the insulating sheath, is engaged around.

Therefore, the connectors have a larger diameter than the cable core and become correspondingly thick, i.e. result in a thickening of the cable core in the region of the separation points.

In order to improve the stability of the cable core, it is furthermore known for the connected core sections and the connectors to be provided with a common taping. This means that an additional layer is applied, resulting in increased manufacturing outlay. Moreover, the diameter of the cable core is also increased and consequently the flexibility reduced, making it harder to roll up a cable formed from such cable cores for the purpose of transportation.

In order to produce such a cable core, a raw core is fed continuously to a processing machine and separated in a recurring manner at each particular separation point at the predetermined longitudinal positions there such that the two core ends are present at the separation point. These are pulled apart in the cable longitudinal direction and connected again with the connector. This means that they have to be briefly conveyed at different conveying speeds by the processing machine in order to set the spacing. In addition, it is necessary to monitor the spacing in order to ensure that the predetermined spacing is actually set.

SUMMARY OF THE INVENTION

The invention is based on the object of specifying an improved cable core which is as compact as possible and easy to handle. Furthermore, a cable based on the previously known cable core is intended to be specified. In addition, an improved method for producing a cable core is intended to be specified, which is furthermore suitable for producing the abovementioned, improved cable core.

To this end, provision is made for a cable core for a cable containing a plurality of such cable cores to have a conductor which is interrupted at a plurality of separation points at predetermined longitudinal positions in the longitudinal direction, forming two conductor ends. In particular, the cable core is provided for use for an induction cable having a plurality of such cable cores. In order to connect the conductor ends, an insulating intermediate piece is provided in this case, on both sides of which the conductor ends are arranged. Furthermore, the conductor and the intermediate piece are jointly surrounded by a continuous insulating sheath to form the cable core. As a result, in particular a cable core that is suitable for an induction cable is realized. By means of the continuous insulating sheath, in particular good stability and tensile strength of the cable core are achieved. Advantageously, the insulating sheath serves both for electrical insulation of the conductor in the radial direction and for connecting a number of conductor sections separated by separation points. As a result, the structure of the cable core is simplified. Advantageously, the manufacturing outlay for such a cable core is reduced as a result.

A common, continuous insulating sheath is understood here to mean that the insulating sheath is applied in particular directly to the conductor and is passed continuously over the intermediate piece. In terms of production, this manifests itself in that first of all only the electrical conductor is provided and the intermediate piece is introduced before the insulating sheath is subsequently fitted over the conductor strand formed thereby, consisting of individual conductor sections and the intermediate pieces arranged in between. In contrast to the prior art, there is thus no severing of a cable core with subsequent connecting of the core ends by a connector. A cable core is understood in general as meaning a conductor surrounded by a core sheath. In the prior art, a conductor surrounded by the core sheath is therefore severed and subsequently connected again via the connector. Therefore, at the conductor ends, which are connected together via the intermediate piece, no additional core sheath is arranged between the insulating sheath and the actual conductor.

A core sheath is understood here to be a usually extruded-on sheath made of an insulating material, in particular PFA, which typically has a wall thickness in the range of greater than 0.1 and up to 0.8 mm, in particular in the range of 0.2 to 0.6 mm.

The conductor is optionally a stranded cable or a solid conductor wire made of a suitable conductive material, in particular copper. The conductor preferably has a diameter in the range of 0.8 to 2 mm, in particular in the range of 1.0 to 1.4 mm.

The wall thickness of the insulating sheath is preferably in the region of a few tenths of a millimeter, in particular in the range of greater than 0.2 and up to 0.8 mm, preferably in the range of 0.2 to 0.6 mm.

The conductor is in particular a coated conductor, for example a copper conductor provided with a nickel layer. As a result of this additional coating, destructive influences on the copper conductor at high temperatures when the induction cable is used in the field are avoided. Alternatively or in addition, the conductor is surrounded in particular by conductor insulation, in particular made of PFA, which is correspondingly omitted at the conductor ends.

Compared with copper, such a nickel layer has only comparatively low conductivity, in particular at the surface of the conductor, this being critical in particular with regard to the low penetration depth of the electrical field on account of the usually applied high frequencies in the range of 50 kHz to 200 kHz. Therefore, instead of a nickel-coated conductor, a silver-coated conductor is preferably used. The layer thickness both in the case of a nickel-coated conductor and in the case of a silver-coated conductor is for example in the range of 0.8 to 1.5 μm.

Alternatively or in addition to the nickel-/silver-coated copper conductor, what is known as an enameled wire is used as the conductor. In the case of the latter, the metallic conductor material is provided with a thin coating layer. The latter typically has merely a layer thickness in the range of less than 100 μm. Thus, this coating layer does not form a core sheath. Rather, the additional insulating sheath continues to be required. In addition to the protection of the conductor by the applied coating, the latter supports the insulation and as a result provides additional protection from partial discharges.

The use of superconductors is furthermore possible in principle as the conductor material.

The insulating sheath is preferably applied to the conductor strand by an extrusion process. Alternatively, it is possible, rather than or in addition to an extruded insulating sheath, to form or develop the latter by a taping/wrapping.

The cable core is therefore formed as a whole by an internal conductor strand having the common insulating sheath surrounding it. The cable core is in this case in the form of endless material obtainable by the meter. Preferably, the conductor strand extends together with the insulating sheath along the entire length. The conductor strand itself is in turn formed by a multiplicity of conductor sections which are each connected together and spaced apart from one another via the intermediate pieces. The conductor strand is therefore a conductor that is interrupted at defined, for example periodic spacings by insulating pieces.

As a result of the arrangement of the intermediate piece on the (raw) conductor with the sheathing with an insulating sheath only subsequently taking place, the particular advantage of simplified quality control is achieved, inter alia. Specifically, it is thus possible to already check the formed conductor strand with regard to a desired good connection of the intermediate piece to the conductor ends and to reject it in the event of quality defects. This therefore takes place in a very early production step, with the result that the production costs are kept low.

The conductor of the cable core is subdivided by the separation points in particular periodically into a number of conductor sections, which are separated from one another at the longitudinal positions. The separation points are in this case separated from one another at a predetermined contact spacing of typically several tens of meters, for example about 100 m. When a plurality of cable cores are combined, in particular stranded, to form a cable, a process-related offset of the separation points of different cable cores with respect to one another may occur; the conductor sections of different cable cores are then displaced in the longitudinal direction with respect to one another. In other words, the longitudinal positions in particular of adjacent cable cores are not aligned optimally with one another with regard to the longitudinal direction, and in particular not in a common plane transversely to the longitudinal direction of the cable.

The conductor ends formed at each particular separation point are then arranged in an offset manner in the longitudinal direction, with the result that disadvantageous partial discharges can occur during operation. Therefore, in a preferred configuration, the intermediate piece has an intermediate piece length which is at least 0.5%, preferably at least 1% and more preferably at most 4% of the section length. Such an intermediate piece is also known as a long intermediate piece. In this way, in spite of a possible offset, an overlap of the intermediate pieces is realized and the resistance to partial discharges at each particular separation point is considerably improved. In this case, the intermediate piece length is selected in particular such that a process-related offset of the conductor ends at a separation point is compensated. For example, an offset of about 2% results, which, at a section length of for example 100 m, is then about 2 m. In this case, the intermediate piece length is then selected such that it is about 2 m.

Preferably, in particular in the above-described case of a long intermediate piece, the respective conductor ends are provided by one adapter element each. To this end, the adapter element is placed on the conductor end. In a preferred configuration, the conductor ends, spaced apart approximately by the intermediate piece length, are each connected to the intermediate piece via a preferably sleeve-like adapter element. The adapter element is for example a sleeve, a core end cap or a joint. The intermediate piece is then arranged between two adapter elements and also fastened thereto in a suitable development. Each particular cable core then has in particular the following structure in the longitudinal direction in the region of a separation point: conductor section, adapter element, intermediate piece, adapter element, conductor section.

The adapter element in this case exhibits only a fraction of the length of the intermediate piece and is for example only a few centimeters long. Its length is therefore typically in the region of less than 8% and in particular less than 4% or less than 2% of the length of the intermediate piece.

Depending on the configuration of the adapter element, it is possible to produce the intermediate piece either from an insulating material or from a conductive material. Thus, in the case of an insulating adapter element, use is made for example of a wire, in particular made of the same material as the conductor. In the case of an adapter element made of a conductive material, an intermediate piece made of an insulating material is accordingly selected.

The adapter element is preferably a brass sleeve. In a preferred configuration, the intermediate piece is configured as a flexible, tension-resistant element. The intermediate piece is preferably produced from an insulating high-temperature material, for example of PFA, PTFE or aramid or generally of an insulating and tension-resistant material.

In a preferred development, the intermediate piece contains a tension-resistant core and an insulating sheathing which surrounds the core. As a result, the intermediate piece is particularly robust, in particular under tensile load, and at the same time particularly flexible. In this case, the core is preferably made of aramid or alternatively of some other tension-resistant and insulating material, and the sheathing is made of PFA. In particular, the sheathing is selected such that a particularly good connection to the subsequently applied insulating sheath results.

The insulating sheath is, in a suitable configuration, applied to the intermediate piece, the adapter piece and the conductor directly in the manner of a flexible tube. In a suitable alternative, the insulating sheath is by contrast formed as a taping directly around the intermediate piece, the adapter piece and the conductor.

However, in a preferred alternative, in order in particular to improve safety with regard to partial discharges, each particular conductor end is surrounded by a joint which is in turn surrounded by the continuous insulating sheath. As a result of the attachment of the additional joint, the risk of air inclusions during the application of the insulating sheath is considerably reduced and as a result resistance to partial discharges is then significantly improved. The joint is preferably made as an injection-molding or casting to this end. Since an adapter element is possibly attached to the conductor end, the joint then surrounds the conductor end only indirectly, i.e. the joint is arranged around the conductor end and the adapter element, in particular molded around these. As a result, in particular air inclusions in the region of a possible interstice between the adapter element and conductor are avoided.

In this case, the joint exhibits only a fraction of the length of the intermediate piece and is for example only a few centimeters long. Its length is then typically in the region of less than 10% and in particular less than 5% of the length of the intermediate piece.

Preferably, the adapter element is enclosed completely by the joint, with the result that a particularly firm hold of the entire arrangement is achieved. The joint in this case extends in the longitudinal direction in particular along a length which is at least somewhat greater than the length of the adapter element, for example around twice as great. The joint then bears in each case against the ends in particular of the conductor or of the intermediate piece. The insulating sheath is applied continuously around this entire arrangement.

In addition, the joint is then embodied in particular such that it causes a particularly shallow expansion of the diameter of the cable core in the longitudinal direction, such that when the insulating sheath is applied, in particular extruded on, any air inclusions are avoided. To this end, provision is made in particular for the joint to taper conically preferably toward its end regions. The joint preferably molds itself to the conductor with only a slight gradient. For example, the diameter increases in the direction of the adapter at only about 0.5 mm per centimeter in the longitudinal direction, i.e. at a gradient of about 5%, and decreases again in a corresponding manner after the adapter element.

In a preferred configuration, the insulating sheath is configured in at least two layers, having two layers of different materials which have in particular different dielectric constants. In this way, in particular the resistance to partial discharges is improved in the case of a plurality of adjacent cable cores. In a preferred development, the insulating sheath is configured in three layers.

Preferably, one of the layers of the insulating sheath is made of PTFE and in particular is sintered. This allows particularly robust and effective insulation of the cable core. Sintering then takes place preferably after the application of the PTFE layer and before the application of a further layer. The second layer is then produced preferably from PFA as the material having a different dielectric constant. In a preferred configuration, first of all a PTFE layer is applied as taping and subsequently a PFA layer is extruded on. In a suitable variant, two PTFE layers are applied one on the other, in particular in each case taped and sintered, wherein one of the PTFE layers is produced from a modified PTFE. Preferably, a PFA layer generally forms an outermost layer of the insulating sheath and a PTFE layer forms a layer arranged inside the PFA layer.

In a suitable variant, the conductor is surrounded by conductor insulation which is then in particular likewise interrupted at the separation points. The conductor insulation allows in particular improved application of the insulating sheath. Preferably, the conductor insulation is additionally removed at least at the conductor ends, in order to realize a particularly good hold of each particular conductor end in the adapter element or on the intermediate piece. The conductor insulation is preferably selected such that a particularly good connection to the insulating sheath and in particular also a possibly present joint results. Therefore, the conductor insulation is preferably produced from PFA.

The regular result of the connection of the conductor ends by means of a connector is that an undesired thickening is formed in the region of the connection point. In contrast, as a result of the common insulating sheath, preferably substantially no additional thickening occurs in the region of the intermediate piece. As a result of the configuration with the common insulating sheath, a cable core having a substantially identical diameter is preferably realized, even in the region of the separation points. To this end, in an advantageous development, provision is made for the intermediate piece and the conductor to be aligned in the longitudinal direction. This results in particular in a particularly compact configuration of the cable core with regard to the diameter. The intermediate piece advantageously does not become thicker, with the result that in particular the cable is easier to handle. Since the conductor typically has a circular cross-sectional profile transversely to the longitudinal direction, the intermediate piece is suitably configured in a cylindrical manner.

The intermediate piece is produced from an insulating material, for example from a plastics material (for example PFA, FEP, MFA, PTFE or aramid). In the cable core, partial discharges between the conductor ends facing the intermediate piece are prevented. To this end, in an advantageous configuration, the intermediate piece is produced from a ceramic, which is distinguished in particular by good resistance to partial discharges. The material used is preferably transparent, thereby making in particular optical/visual quality control of the connection easier. The intermediate piece preferably has a length in the range of about 3 to 10 mm, with the result that in particular optimal efficiency of the entire arrangement is achieved. In the above-described alternative variant, the intermediate piece is much longer, however, and has in particular a length in the region of one or more meters.

In an advantageous configuration, the intermediate piece has a lateral surface with undulating profiling, with the result that in particular leakage currents from one conductor end to the other via the intermediate piece are reduced or entirely suppressed. In other words, the resistance to partial discharges is improved. The safety with regard to partial discharges is furthermore improved in particular in that the intermediate piece is formed with the conductor ends, with formation of air inclusions being avoided. This high safety with regard to partial discharges is achieved in particular also by a suitable material selection of the intermediate piece, preferably ceramic. As a result of the use in particular of a prefabricated intermediate piece, this intermediate piece can already be quality-controlled in advance. In contrast to a method in which the intermediate piece is formed by an injection-molding process directly for connecting the conductor ends, it is therefore possible in the present case—even when intermediate pieces made of plastics material are used—to reliably rule out a situation in which the safety with regard to partial discharges is reduced for example by air inclusions in the case of a defective injection-molding process.

In a preferred configuration, the intermediate piece has a first end face and the conductor end has a second end face facing this first end face. Expediently, at least the first end face is then formed in a round manner. This is understood as meaning in particular that the first end face is circular, in particular in a plane perpendicular to the longitudinal direction. Such a round configuration is particularly advantageous with regard to the electrical properties of the intermediate piece, i.e. in this case in particular the insulation effect thereof. Preferably, the first and the second end face are each provided with a profile. In the case of the conductor end, the profile is advantageously formed directly by the separation process. Alternatively, the profile is formed by subsequent processing. Alternatively, a suitable cap is applied to the conductor end, in other words the conductor end is capped. Preferably, this cap is made of metal and for example soldered on or welded to the conductor end. If only one face defined by the end sides is available for connecting the intermediate piece to the conductor ends, the face is enlarged by a suitable profile and as a result in particular the stability of the connection is improved.

Advantageously, the end faces are formed in a round manner. In a suitable configuration in this regard, the first end face is convex and the second end face concave in a complementary manner, or vice versa. Preferably, at least the conductor end is configured in an edge-free manner, i.e. in particular the conductor end does not have any or only rounded edges in a cross section in the longitudinal direction. Rounded is understood here as meaning that the edge has a radius of curvature which does not drop below a minimum radius of curvature defined by field calculations. In particular, the radius of curvature is greater than 0.2 mm. This results in an edge in particular at the transition from the second end face to the lateral surface of the conductor. An edge-free configuration results in particular in increased resistance of the cable core to partial discharges in the region of the intermediate piece. Preferably, any edges at the conductor end are avoided in that the second end face is embodied in a round manner and in an outwardly domed manner with respect to the conductor, i.e. in particular as a convex hemispherical surface. As a result, a correspondingly hemispherical conductor end is formed, which is preferably bordered by the intermediate piece of complementary form. In a suitable alternative, a hemispherical cap or a cap having rounded edges is fastened to the conductor end, for example soldered thereto. The cap is expediently made of metal, in particular of the same material as the conductor. Also suitable is a conical configuration of the conductor end, in which the second end face is formed in a correspondingly conical or frustoconical manner. In this case, any edges are expediently embodied in a rounded manner. A further configuration in which the second end face is formed in a circular manner and in particular has rounded edges in the longitudinal direction is also suitable.

In a further suitable configuration, the first and the second end face are configured in a manner similar to a plug coupling. To this end, either the intermediate piece or the conductor end has a protrusion, peg or pin which is inserted or plugged into a complementary recess in the conductor end or the intermediate piece, respectively.

Expediently, the conductor is in the form of a hollow wire having a cavity extending in the longitudinal direction. Not only is material advantageously saved through the use of a hollow conductor, but also there is an in particular circular opening at the conductor end. A suitably shaped intermediate piece is inserted in the opening.

The stability of the connection is improved for example by a press fit and/or suitably applied profiling. For example, the protrusion has a thread and is screwed into the complementary recess. Alternatively or in addition, the conductor end and the intermediate piece are adhesively bonded together, or welded.

In a suitable development, a strain relief device is fitted in the cavity of the conductor in the form of a hollow conductor. Advantageously, the intermediate piece additionally has a continuous cavity in the longitudinal direction and the strain relief device is embodied in a continuous manner similarly to the insulating sheath of the finished cable core, thereby improving in particular the tensile strength of the cable core. In other words, the intermediate piece is embodied as a hollow cylinder.

In an alternative development, the intermediate piece is formed by an injection-molding method between two conductor ends to be connected. In combination with a hollow conductor, a protrusion that projects into the cavity and in particular improves the stability of the connection is formed in this case by the injection-molding. Advantageously, the injection-molding is embodied such that the intermediate piece and the conductor are aligned.

The conductor ends are welded for example to the intermediate piece. To this end, the intermediate piece is advantageously metalized at its ends. In the case of an intermediate piece made of a ceramic, a particularly stable connection by formation of enameling is achievable as a result. This is the case in particular in combination with a nickel-coated conductor. Suitably, the separated conductor has at least partially an in particular annular coating of nickel on its end face. As a result, it is in particular possible to connect, preferably to weld, a ceramic intermediate piece aligned with the conductor to the end face by means of enameling. Alternatively, an intermediate piece made of ceramic, in particular a low-melting-point glass, is cast or pressed onto the conductor end.

In order to achieve high flexibility of the entire cable core, the intermediate piece is advantageously severed, in particular transversely to the longitudinal direction. Alternatively, the intermediate piece is merely notched. In this case, one or more notching points or separation points are provided. The intermediate piece is therefore preferably formed generally as an element with low torsional or flexural rigidity. As a result, it is in particular possible to prevent damage to the cable core by torsional forces, as occur for example during stranding of a number of cable cores. Furthermore, the cable core is in particular easier to roll up and easier to transport on account of the improved flexibility.

In order to improve the stability and tensile strength of the cable cores, the intermediate piece is expediently configured as a core end cap (or ferrule) and the conductor end fits in a recess introduced into the end of the intermediate piece. The recess is for example cylindrical, conical or hemispherical. In this case, either only one individual core end cap is provided, which is arranged between two conductor ends and is attached to one of the conductor ends, or a plurality of core end caps are provided, preferably two, which are each attached to a conductor end. In the latter case, the core end caps form in particular a separate intermediate piece having the advantages already mentioned above. In particular, the conductor end is suitably configured in a manner complementary to the recess. Preferably, the conductor end is configured in a round manner, thereby improving in particular the resistance to partial discharges. The core end cap is in particular made of a conductive material and is connected to each particular conductor end in an electrically conductive manner.

Suitably, the core end cap contains an end part and an in particular sleeve-like collar, flange or sheath extending therefrom in the longitudinal direction. The latter advantageously engages around the conductor end in the radial direction, as a result of which in particular the area available for producing the connection is enlarged. Preferably, the conductor end is connected to the core end cap by means of a press-fit. This type of connection is in particular easy to carry out and particularly stable. Alternatively or in addition, the core end cap is for example soldered, welded, sintered, crimped or squeezed onto the conductor end. In particular for soldering, the recess in the core end cap is preferably at least partially metalized, for example provided with a nickel layer.

Advantageously, the core end cap is adhesively bonded to the conductor end, for example by a polyimide adhesive. In the case of an intermediate piece adhesively bonded by an adhesive, the adhesive is preferably insulating. The adhesive bonding is suitably carried out in addition to one of the forms of connection already mentioned above. Expediently, the collar has a number of teeth or clamping arms. In particular, squeezing of the core end cap onto the conductor end is simplified thereby. In a further alternative configuration, the core end cap is connected to the conductor end by a thermal after treatment, for example in a similar manner to a heat shrink tube being shrunk onto the conductor end or fastened by a thermally curing adhesive.

In particular in the event that the core end cap has a larger outside diameter than the conductor, the insulating sheath is suitably embodied in a thinner manner in the region of the core end cap, in order in particular to ensure a uniform cable core diameter. In an alternative configuration, the radius of the conductor is reduced in the region of the conductor end such that the core end cap is aligned with the rest of the conductor. For example, the radius of the conductor at the conductor end is reduced by turning, milling or etching.

In a preferred development, the recess has a cylindrical and profiled internal wall. For example, the latter has teeth or barbs, thereby realizing in particular pull-out protection. Alternatively, the core end cap has an internal thread on the internal wall, with the result that the conductor end is connected easily and stably to the intermediate piece by screwing. In order to produce a particularly firm screw connection, the conductor end has a substantially smooth lateral surface and the thread is self-tapping. Thus, the intermediate piece is able to be screwed onto the conductor end in particular with a precise fit. In particular, one or all of the developments and advantages of the above-described core end cap are also transferable, mutatis mutandis and generally, to an intermediate piece not in the form of a core end cap.

In a suitable development, the intermediate piece is configured in the manner of a joint, i.e. in a manner similar to two connected core end caps. The abovementioned developments and advantages with regard to an intermediate piece configured as a core end cap are then transferable, mutatis mutandis, to such an intermediate piece configured as a joint. For example, in a suitable configuration, the intermediate piece has, at each of its ends, a thread by means of which the intermediate piece is screwed onto in each case one conductor end. Advantageously, the threads are cut with an opposite direction of rotation, thereby making it easier to mount the intermediate piece.

In an advantageous configuration, an adapter element is attached to the end of the intermediate piece to form a prepared intermediate piece. For example, the adapter element is a conductor piece similar or identical to the conductor used for the cable core. By providing such prepared intermediate pieces, the production of the cable core is simplified in particular to the effect that only two similar or identical materials have to be connected together. The conductor and the adapter element are produced for example from copper. The conductor end and the intermediate piece are advantageously connected together by a welding method, in particular by a cold welding method.

The object is furthermore achieved according to the invention by a cable, in particular what is known as an inductor cable having a multiplicity of cable cores as described above.

Expediently, a plurality of groups of cable cores, in particular two groups, are formed in this case, wherein the intermediate pieces of the cable cores of one group are each arranged at the same axial length. The intermediate pieces of the cable cores of the two groups are therefore offset with respect to one another in the longitudinal direction and preferably exactly by half a spacing dimension between two successive intermediate pieces in each particular cable core. The intermediate pieces are in this case preferably arranged at a fixed, periodically recurring spacing in all cable cores.

In order in particular to compensate for a production-related offset in the intermediate pieces of a group at a longitudinal position, the intermediate pieces arranged at this longitudinal position expediently have an intermediate piece length which corresponds to at least 0.5%, preferably at least 1% and more preferably at most 4% of a section length of the conductor. The section length is in this case the length of a conductor section and corresponds approximately to the abovementioned spacing dimension.

The entire inductor cable is in this case preferably formed by a plurality of, in particular three, part-cables which each consist of a plurality of cable cores.

In particular, the cable and in particular each part-cable consists of a plurality of core bundles, which in turn consist of a multiplicity of individual cable cores. For example, a plurality of core bundles, in particular seven core bundles, are arranged around a central strand, in particular for strain relief.

Each core bundle in turn preferably consists of a plurality of layers of individual cable cores, which are preferably likewise arranged around a central strand, in particular in turn for strain relief.

Advantageously, a plurality of cable cores are stranded together. Such a cable having stranded cable cores is in particular easy to manufacture. Furthermore, such a cable is particularly easy to transport. In particular, such a cable is easy to lay. In order to form the core bundle, a plurality of layers of cable cores are stranded together and in particular about a strain relief means (for example made of aramid), advantageously in an SZ stranding pattern. For example, an inner layer comprises six cable cores and an outer layer 12 cable cores. A plurality of such core bundles, for example seven thereof, are then stranded together about a further strain relief device and form a part-cable. A plurality of such part-cables, for example three thereof, are then stranded together to form the induction cable. During each stranding operation, the laying direction is set in a suitable manner, for example such that two successive stranding operations form an SZ stranding pattern.

In an alternative embodiment, a number of cable cores, core bundles and/or part-cables are each braided or entwined together. In particular, on account of the cable cores overlapping partially in the longitudinal direction, the induction cable has a capacitance value which is advantageously settable. In the case of a selectable pitch of the entwined core bundle, part-cable or induction cable, this capacitance value is settable through a suitable choice of the pitch.

In order to combine in each case a plurality of cable cores into the core bundle, a plurality of core bundles into the part-cable and/or a plurality of part-cables into the induction cable, a number of sheaths or tapings are suitably provided. In other words, after each substep in the production of the cable, in particular one or more sheaths are provided.

However, such additional sheaths and/or tapings are advantageously dispensed with, with the result that in particular a compact structure of the induction cable is possible. Preferably, the cable cores, the core bundles and the part-cables are each stranded directly together and only one sheath is finally applied in order to combine the part-cables into the induction cable.

Preferably, a plurality of part-cables are connected to form the induction cable, in particular stranded and provided with a sheathing configured in particular as a taping such that the induction cable has a triangular profile with rounded corners in cross section with respect to the longitudinal direction. The induction cable is in particular noncircular in cross section in a preferred configuration. As a result, in particular material for the sheathing can be saved. Furthermore, such an induction cable is easier to lay. This is because such induction cables are usually pushed or pulled into pre-laid pipes. The nonround configuration of the cable, in particular having a triangular cross-sectional profile with rounded corners, makes it possible to easily introduce the cable into such pipes with only little friction. In principle, it is also possible to dispense with the outer sheathing which thus surrounds the three part-cables. The total of three part-cables fit in the corners of an imaginary triangle.

In a further alternative embodiment, a number of cable cores are present as a bundle, i.e. not stranded together. To this end, a number of cable cores are guided in a straight line, that is to say in particular not in a spiral, in the longitudinal direction. For example, the cable cores of a core bundle are in a bundled form and a number of such core bundles are in turn stranded together. In this way, it is possible to produce the induction cable more easily and in particular to provide a certain degree of stranding at the same time.

In an advantageous configuration, a number of cable cores are embodied in the manner of a ribbon cable such that these cable cores have a common insulating sheath applied to their conductor. In other words, a number of conductors are combined into a ribbon cable by insulation applied jointly thereto. This means that the ribbon cable is embodied in a similar manner to a number of combined cable cores. Instead of or in addition to stranding a number of cable cores to form a cable, it is thus possible to form a multicore cable by way of taping operation with the ribbon cable. To this end, for example a strain relief device is provided as the core about which the ribbon cable is taped. In a suitable development, a plurality of ribbon cables are arranged in particular in a plurality of layers by taping to form a cable or a part-cable. For example, a six-core ribbon cable is taped about a strain relief device and a twelve-core ribbon cable is taped around the six-core ribbon cable. In this case, the two ribbon cables are suitably wound in a similar manner to an SZ stranding pattern, that is to say they extend with an opposite direction of rotation to one another.

For operation, the cable is attached in particular to a power source such that a current flows in the cable and a voltage is applied thereto. In the case of an induction cable, the power source is typically an AC power source and the current and the voltage have a frequency.

Preferably, the cable has a sensor module having at least one sensor for determining at least one value of an operating parameter of the cable. In this case, operating parameters are understood as being for example the current, the voltage and/or the frequency. A further operating parameter is for example a temperature measured in the cable. By determining the value of one of these operating parameters, it is possible in particular to monitor the functionality of the cable. For continuous monitoring, a plurality of values of the operating parameter are suitable sensed over a given period of time. Preferably, a plurality of sensor modules are arranged along the length of the cable.

The induction cable is regularly installed, or buried, in a reservoir (or generally in the ground), for example in an oil sand field. Typically, a pipe laid in the reservoir is provided, into which the induction cable is pulled or installed. The state of the reservoir is characterized by one or more environmental parameters, for example temperature, density, viscosity or conductivity of the reservoir. A parameter can in this case assume different values at different points in the reservoir. In order to monitor the state of the reservoir, the sensor module(s) is/are additionally or alternatively configured to determine at least one value of such an environmental parameter.

Advantageously, the operating parameters or environmental parameters are determined with time resolution. For example, the sensor module is equipped with an acoustic signal transmitter and a microphone for carrying out seismic measurements and carries out seismic measurements at predetermined time intervals. Since the sensor module is suitably in a position that is substantially unchanged over time, it is possible in particular to characterize the reservoir and the state thereof with time and position resolution. For the various parameters, different sensors or sensor modules are preferably integrated in the cable.

Advantageously, the sensor module additionally contains control electronics, in particular in order to evaluate the values determined. Furthermore, the control electronics advantageously generate control and/or warning signals, for example in order, in the event of a defect in the cable, to interrupt the power supply thereto and to prevent further damage.

The sensor module and/or the control electronics are suitably connected to a central processing unit, for example a computer. In particular in the case of a plurality of sensor modules, data from various points in the cable and/or reservoir can be compiled in this way. Preferably, the cable has a data line which serves in particular for forwarding data determined by one or more sensor modules. Suitably, the induction cable contains at least one optical fiber which is configured for example for data transfer and/or as a temperature sensor. The optical fiber is suitably introduced directly into the induction cable during the production thereof, for example stranded together with the cable cores. Alternatively, the optical fiber is guided along a strain relief device or introduced instead of such a strain relief device.

In a preferred development, an energy supply of the sensor module and/or of the control electronics is realized such that energy is taken from the induction field generated by the induction cable.

In a suitable development, the cable core has electronics, in particular for short-circuiting partial discharges at the conductor ends. To this end, the electronics are configured for example as a resonant circuit, high-pass filter or band-pass filter. Suitably, the electronics are electrically connected to both conductor ends. Advantageously, such electronics are provided for each respectively opposite pair of conductor ends. In a suitable development, the electronics are able to be switched on and off by a user. By means of the electronics, it is in particular possible to improve the resistance of the induction cable to partial discharges. Advantageously, the partial discharges are short-circuited by the electronics.

The object is furthermore achieved according to the invention by a method for producing a cable core. In this case, the advantages and configuration of the cable core already disclosed above also apply, mutatis mutandis, to the method.

In order to produce the cable core, in particular according to the abovementioned embodiments, provision is made for first of all a sheathless conductor to be provided, which is separated in a recurring manner at predetermined longitudinal positions such that two conductor ends spaced apart by an intermediate space are formed. Preferably, a conductor provided in particular as a raw wire is separated in a recurring manner. Separation takes place for example by means of a cutting or punching method. An intermediate piece, in particular made of an insulating material, is then introduced into the intermediate space and connected to the conductor ends such that the latter are located opposite one another in the longitudinal direction. Subsequently, the conductor and the intermediate piece are jointly provided with a continuous insulating sheath to form the cable core. The latter is for example extruded on or applied in the form of a taping.

In the present case, a sheath less conductor is understood to be a raw conductor, for example a solid raw wire, a stranded wire or an enameled wire, which is free of a core sheath, i.e. is free of an extruded-on or wrapped-on insulating sheath.

As an alternative to the separation of a raw wire, individual conductor segments of the desired length are provided and connected via the intermediate pieces. In both variants, a conductor strand is retained, which is made up of a multiplicity of individual conductor segments of in particular an identical length which are each connected together via the intermediate pieces. The conductor strand has sufficient mechanical tensile strength overall in order to be treated further for further process steps in a similar manner to a conventional raw wire and in order to apply the continuous insulating sheath for example by way of an extrusion operation or by way of a taping operation.

When the intermediate piece is connected to the conductor ends, air inclusions are preferably avoided, with the result that the safety with regard to partial discharges is improved. To this end, a in particular automatic quality control method is provided, which is accordingly suitable for verifying air inclusions. For example, an ultrasound or x-ray method. In particular in the case of an intermediate piece made of a transparent material, use is preferably made of an optical method, for example an image processing method by a camera operated in bright-field and/or dark-field illumination.

Suitably, a number of conductor strands arranged alongside one another, i.e. of conductors provided with intermediate pieces are jointly provided with the insulating sheath in the manner of a ribbon cable, for example by way of an extrusion operation. Preferably, the conductors are arranged in this case such that only every second conductor is interrupted at a first predetermined longitudinal position on the ribbon cable. The conductors not interrupted at the first longitudinal position are interrupted at a second predetermined longitudinal position that follows in the longitudinal direction. As a result, an overlap suitable for forming an induction cable is in particular ensured in the longitudinal direction by conductor sections predetermined by the separation points.

Since, to form an induction cable at a predetermined longitudinal position, typically only every second conductor is severed, in an alternative configuration a number of sections are separated, for example punched, out of the ribbon cable to form separation points, such that only every second conductor and a section, assigned thereto, of the insulation are separated out at a predetermined longitudinal position. On account of the remaining common insulation, the separation points are furthermore positioned correctly with respect to one another. The separating out preferably takes place such that the intermediate pieces inserted at a predetermined longitudinal position are furthermore present at the same longitudinal position in the finished cable, that is to say in particular in a cable stranded with a particular lay length. Advantageously, the sections are therefore punched out in a suitably offset manner, taking the lay length into consideration. In an alternative configuration, the sections are punched out in a non-offset manner, with the result that the intermediate pieces are present at the predetermined longitudinal position in particular in the case of bundling of cable cores to form core bundles, as described for example above.

In an advantageous development, the separated-out sections are provided with suitable intermediate pieces, for example in one of the abovementioned embodiments. Advantageously, the intermediate pieces are each formed by an injection-molding method. Suitably, the intermediate pieces are connected to the insulating sheath, for example sintered or vulcanized, resulting in a particularly firm connection being produced.

In a preferred configuration, provision is made for the conductor—for example when a raw wire is used—to be separated at predetermined longitudinal positions in that a section having a particular length is separated out of it. For example, the section is punched out of the conductor. Alternatively, the section is cut out, for example by a waterjet-cutting or laser-cutting method. This simplifies the formation of the conductor ends such that a predetermined spacing between them does not have to be set subsequently in an additional process step but is set directly by the length of the separated-out section. In other words, the spacing is not set only after separation but already during the separating operation. The length of the separated-out section is suitably set depending on the operating parameters of the cable core, for example voltage, current and/or frequency.

Suitably, the intermediate piece is separated into at least two subsections following the connection at a separation point, in particular transversely to the longitudinal direction. Alternatively, the intermediate piece is merely notched. As a result, a separated intermediate piece having the above-mentioned advantages is advantageously formed.

A large number of the preferred variant embodiments and advantages described with regard to the independent claims do not necessarily adhere to the specific configuration of the cable core as per the main cable claim, according to which the conductor and the intermediate piece are jointly surrounded by a continuous insulating sheath. The same goes for the independent method claim, according to which a conductor strand formed from individual conductor segments connected to the intermediate pieces is provided and is subsequently jointly surrounded by the insulating sheath. In a large number of these preferred variant embodiments, independently stand-alone inventive aspects are provided, which are considered capable of protection per se independently of the specific combination of features in the independent claims, in particular independently of the features in the characterizing part of the claim. We reserve the right to file divisional applications for these aspects. These aspects can therefore also be used for example for the cable described in international patent disclosure WO 2013/079201 A1 or the cable cores, described therein, of the applicant.

In particular, the following features are therefore concerned:

the configuration of the intermediate piece containing a lateral surface with profiling (external/internal);

the profiling of one or both end faces of the intermediate piece;

metalization of the intermediate piece;

severing or at least notching of the intermediate piece;

the configuration of the intermediate piece as one or more core end caps having a recess with the preferred developments of the recesses;

the configuration of the conductor as a hollow wire with the corresponding preferred configurations;

the configuration with the ability of the intermediate piece to be screwed to the conductor or to a core end of a core (conductor provided with a core sheath);

the in particular triangular structure of the cable, in particular consisting of three part-cables;

the structure of the cable from a plurality of core bundles, preferably of individual cores arranged in layers;

the use of conductors provided with a nickel layer or silver layer, or the use of an enameled wire as conductor;

the integration of a strain relief means in the intermediate piece and/or in the conductor, in particular in the configuration as a hollow conductor;

SZ stranding of the individual cable cores;

the integration of electronics in particular for short-circuiting partial discharges with preferred configurations;

an automatic quality control method for increasing the safety with regard to partial discharges, in particular for verifying air inclusions in the intermediate piece;

the construction of the cable from ribbon cable, in particular with the variant according to which, in conventional ribbon cables, conductor segments are separated out with the insulation and subsequently intermediate pieces are inserted, and the preferred developments with respect to the ribbon cable;

the configuration of the intermediate piece from ceramic;

the formation of the intermediate piece as a long intermediate piece;

the fitting of the joint around the adapter element; and the specific multilayer structure of the insulating sheath.

Other features which are considered as characteristic for the invention are set forth in the appended claims.

Although the invention is illustrated and described herein as embodied a cable core for a cable, in particular an induction cable, a cable, and q method for producing a cable core, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1A:
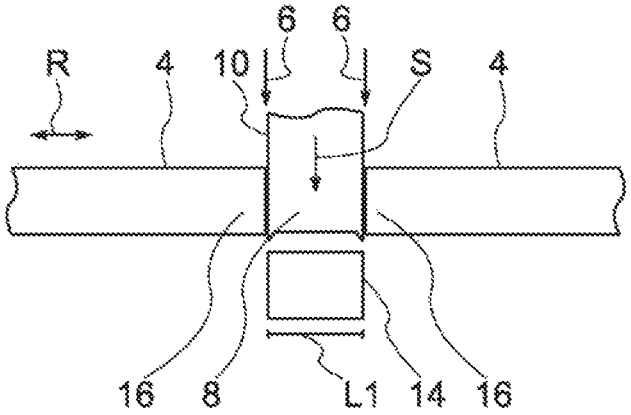
FIGS. 1A to 1C are illustrations showing a production of a cable core according to the invention.
Figure 1B:
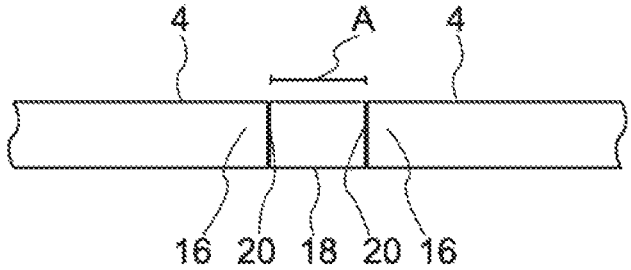
Figure 1C:
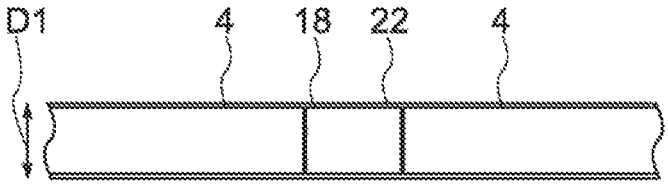

Referring now to the figures of the drawings in detail and first, particularly to FIGS. 1A-1C thereof, there is shown a method for producing a cable core in a view in longitudinal section. In this regard, FIG. 1A shows a conductor 4 in the form of a raw wire which is separated at predetermined longitudinal positions 6, forming an intermediate space 8. To this end, a punching tool 10 having a punching direction S is provided in the exemplary embodiment shown here, the punching tool 10 punching a section 14 with a predetermined length L out of the conductor 4, forming two separation points, wherein two conductor ends 16 are formed.

FIG. 1B shows the conductor ends 16 with an intermediate piece 18 arranged in between. The intermediate piece 18 has two end faces 20 at a predetermined spacing A from one another, wherein this spacing is expediently identical to the separated-out length L1. The conductor ends 16 are connected, for example welded, to the intermediate piece 18.

In the exemplary embodiment illustrated, the intermediate piece 18 and the conductor 4 each have the same diameter and are thus aligned with one another.

After the introduction of the intermediate piece 18, a conductor strand similar to a raw wire is formed, which is provided so to speak as an endless strand, that is to say as what is known as material obtainable by the meter, and can be used for example for the subsequent process steps and if necessary also be temporarily stored in a manner rolled up on a reel. The conductor strand is composed of a multiplicity of conductor sections in particular of identical length, which are each connected to an intermediate piece 18.

Each particular conductor 4 typically has a diameter in the region of a few millimeters, in particular 1 to 3 mm. It is in particular a solid wire, in particular copper wire. The latter is preferably provided with a coating, for example a nickel coating or silver coating. The layer thickness is in this case a few micrometers, for example 1 to 1.5 μm.

The intermediate piece 18 has a length in the region of a few millimeters, for example in the range of 3 to 10 mm and in particular in the region of 5 mm. Accordingly, the spacing between the opposite conductor ends 16 amounts to the length of the intermediate piece 18. The intermediate piece 18 is in the form of a cylindrical intermediate piece in the exemplary embodiment.

The spacing between two successive intermediate pieces 18 in the longitudinal direction and thus the length of each particular conductor section is typically in the region of several tens of meters, for example in the region of 50 m or a multiple thereof, for example in the region of about 100 m. The intermediate pieces 18 are in this case arranged in a manner spaced apart from one another at such a defined contact spacing having this spacing length. The overall length of such a cable core 2 is in the range of several hundred meters to several kilometers.

Following the provision of such a conductor strand consisting of individual conductor segments, connected to the intermediate pieces 18, an insulating sheath 22 is applied, as illustrated in FIG. 1C, the insulating sheath 22 being extruded on from a plastics material here. In this case, the insulating sheath 22 has a constant diameter D1 along the entire cable core 2, in particular also in the region of the intermediate piece 18.

FIGS. 2 to 6 schematically show further exemplary embodiments of the cable core 2 in a view in longitudinal section. Shown in each case is a detail of the cable core 2 in the region of the intermediate piece 18 fitted in the intermediate space 8.

Figure 2:
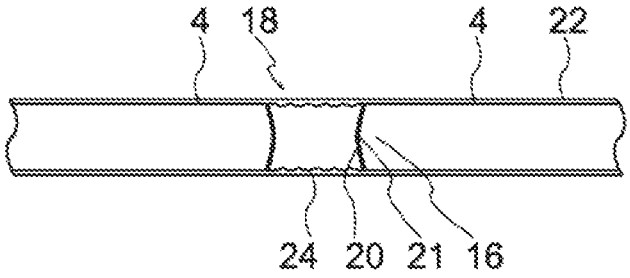
FIG. 2 is a longitudinal sectional view showing the cable core with an intermediate piece.

The intermediate piece 18 illustrated in FIG. 2 is embodied in one piece and in a substantially cylindrical manner, with a lateral surface 24 which is provided with an undulating profile. As a result, leakage currents are avoided and the safety of the cable core 2 with regard to partial discharges is increased. Furthermore, the intermediate piece 18 is aligned with the conductor 4. The end faces 20 are formed in a concave manner in the exemplary embodiment shown here. Each of the two end faces 20 is assigned an end face 21 of one of the conductor ends 16, which is formed in a correspondingly complementary manner, that is to say in this case in a convex manner. The end faces 20 are metalized and welded to each particular conductor end 16.

The intermediate piece 18 is produced from a ceramic in the exemplary embodiment shown here. Alternatively, the intermediate piece 18 is produced from plastics material. In a further alternative, not shown here, the intermediate piece 18 is configured as an injection-molding and is formed directly between the two conductor ends 16 by a suitable injection mold. As a result, it is expediently possible to produce the intermediate piece 18 with a precise fit.

Figure 3:
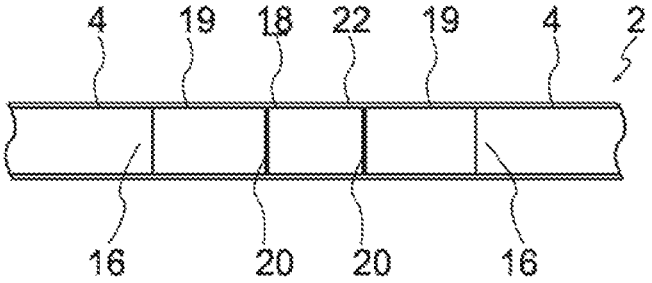
FIG. 3 is a longitudinal sectional view showing a further cable core with a prepared intermediate piece for connecting two conductor ends.

FIG. 3 shows an alternative exemplary embodiment of the cable core 2, with a prepared intermediate piece 18, to each of the end faces 20 of which an adapter element 19 is fastened which is in the form of a conductor section here and is produced in particular from the same material as the conductor 4. As a result of the combination of the intermediate piece 18 with an adapter elements 19, a prepared intermediate piece 18 is formed. The latter is connected to the conductor ends 16 by the adapter elements 19, in the exemplary embodiment shown here by a cold welding method, preferably by a soldering method, in particular brazing. The adapter element 19 is in particular a few millimeters long, for example 1 to 5 mm. It preferably consists of the same material as or at least a similar material to the conductor 4.

Figure 4:
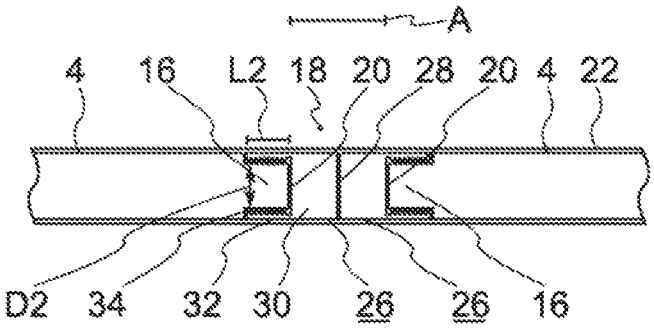
FIG. 4 is a longitudinal sectional view showing the further cable core with an alternative intermediate piece.

FIG. 4 shows an alternative intermediate piece 18 which in this case contains two core end caps 26. In particular, the intermediate piece 18 illustrated here is separated at a separation point 28. The separation can be realized here either directly by the use of two core end caps 26 or alternatively by an intermediate piece 18 in the form of a joint that is severed after being connected to the conductor ends 16.

The core end caps 26 each have a head 30 which contains in particular the end face 20. From the head 30, an annular collar 32 extends in the longitudinal direction R. The collar 32 has profiling on its internal wall 34, the profiling being a thread in this case. Furthermore, the collar 32 extends around a cylindrical recess with a predetermined depth T. The conductor ends 16 have a reduced diameter D2 at a length L2, which expediently corresponds to the depth T, and have been screwed into the core end cap 26. In an alternative configuration, the cutout is conical and the conductor ends 16 are likewise formed in a conical manner in a correspondingly complementary manner thereto.

The heads 30 of the core end caps 26 bear against one another in the exemplary embodiment shown here, and the insulating sheathing 22 is embodied in a continuous manner in this case. In an alternative configuration, the two core end caps 26 are connected together, for example adhesively bonded or welded. The conductor ends 16 fitted in the core end caps 26 can also be adhesively bonded or welded in addition.

Figure 5:
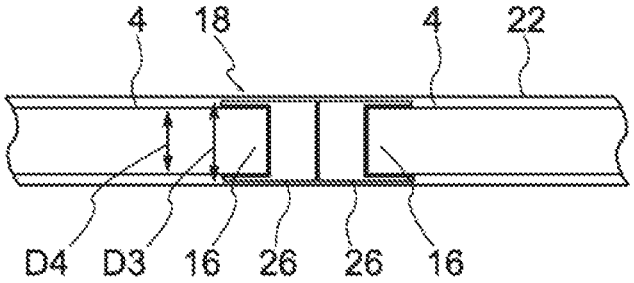
FIG. 5 is a longitudinal sectional view showing the further cable core with the alternative intermediate piece.

FIG. 5 shows a further exemplary embodiment. In the figure, the intermediate piece 18 is embodied as two core end caps 26 which have been fitted on the conductor ends 16 and fastened by a press-fit. To this end, each particular conductor end 16 is cooled and inserted into the core end cap 26. In an embodiment that is not shown here, the core end cap 26 has a profiled internal wall 34 and/or a profiled end face 20 which is developed as per one of the abovementioned configurations.

As FIG. 5 shows, the core end cap 26 has a diameter D3 which is greater than the diameter D4 of the conductor 16. In order that the intermediate piece 18 does not become too thick, the insulating sheath 22 is embodied in a thinner manner in the region of the intermediate piece 18.

Figure 6:
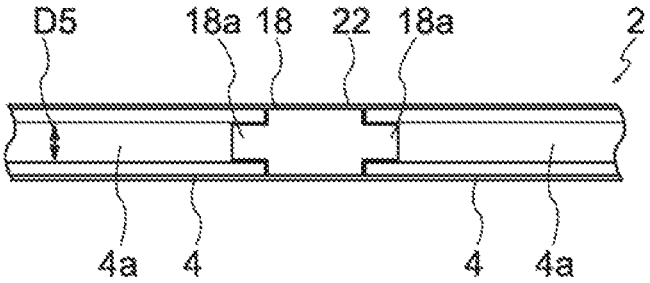
FIG. 6 is a longitudinal sectional view showing a further cable core containing a conductor in the form of a hollow wire.

A further exemplary embodiment of the cable core is illustrated in FIG. 6. Therein, the conductor 4 is in the form of a hollow wire having a cavity 4*a* extending in the longitudinal direction R. The cavity 4*a* has an inside diameter D5 transversely to the longitudinal direction. At the conductor ends 16, the intermediate piece 18 has been inserted in the cavity 4*a* by means of suitably configured protrusions 18*a*. In an embodiment that is not shown here, the protrusions 18*a* have a thread or some other profiling on an internal lateral surface bearing against the cavity 4*a*, in order to improve the stability of the connection. In a further alternative configuration, the cavity 4*a* is filled with a strain relief means which is advantageously connected cohesively to the protrusions 18*a*.

Figure 7:
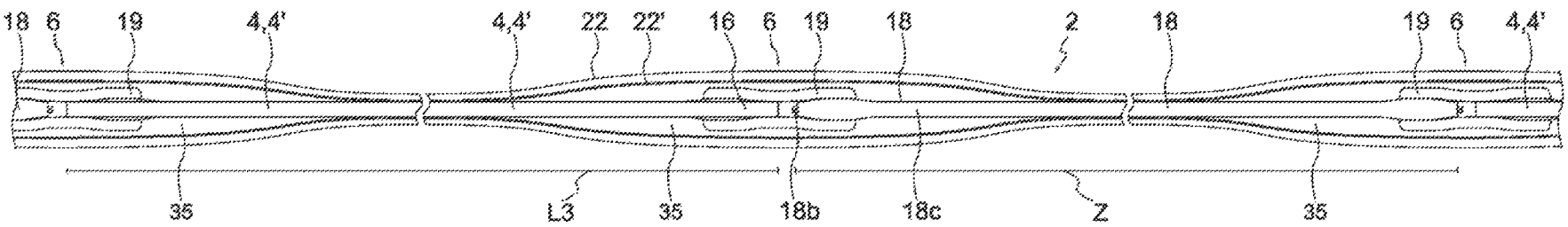
FIG. 7 is a longitudinal sectional view showing a further cable core with a long intermediate piece.
Figure 8:
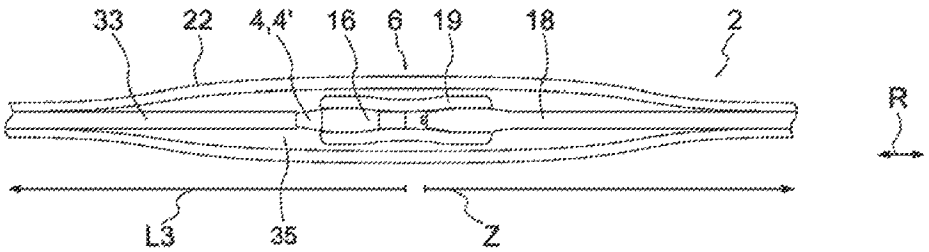
FIG. 8 is a longitudinal sectional view showing a further cable core with a long intermediate piece.

FIGS. 7 and 8 each show a preferred variant of the cable core 2, in which the intermediate piece 18 is in the form of a long intermediate piece 18. This is connected to the connector end 16 by an adapter element 19 in a similar manner to in FIG. 3 and is thus configured in particular as a prepared intermediate piece 18. In this case, FIG. 7 illustrates in each case a complete conductor section 4' and an intermediate piece 18 adjoining it. The intermediate piece 18 has a sleeve-like adapter 19 at each of its ends, for connecting to a particular conductor section 4' at each particular longitudinal position 6. FIG. 8 shows only one longitudinal position 6, i.e. only one of two ends of the intermediate piece 18, which is connected to the conductor end 16 via the adapter element 19; an analogous connection takes place at the other end, not shown here. The conductor 4 is in this case divided into conductor sections 4' which each have a section length L3 which corresponds to the spacing between two conductor ends 16 of a conductor section 4'.

In the exemplary embodiment shown in FIGS. 7 and 8, the intermediate piece 18 has a certain intermediate piece length Z which corresponds to about 1 to 4% of the section length L3. For a section length L3 of about 100 m, the intermediate piece 18 is then for example about 2 m long. In this way, a production-related offset of several intermediate pieces 18 at a separation point 12 is compensated. As a result of the intermediate piece length Z, an overlap of the long intermediate pieces 18 transversely to the longitudinal direction R of the cable 2 is ensured in this case.

Here, the intermediate piece is additionally in the form of a flexible, tension-resistant element and contains a tension-resistant core 18*b* of aramid and an insulating sheathing 18*c*, surrounding the core 18*b*, of PFA.

In FIGS. 7 and 8, the adapter element 19 is in the form of a brass sleeve into the ends of which the intermediate piece 18 and the conductor end 16 of the conductor section 4' are inserted. The entire arrangement is surrounded by a joint 35 which is configured as an injection-molding and is preferably made of PFA. In this case, the joint 35 completely surrounds the adapter element 19 and the conductor end 16 attached thereto. Advantageously, the joint 35 additionally fills the interstice formed by the adapter element 19 in each case with the conductor section 4' and the intermediate piece 18.

In order to form the cable core, the insulating sheath 22 is finally applied around this overall arrangement, the insulating sheath 22 being embodied in three layers in the exemplary embodiments in FIGS. 7 and 8, in a manner not shown in more detail, specifically with an internal taping of modified PTFE, a further taping of PTFE applied thereto, and an external layer of extruded PFA, wherein the two tapings are additionally sintered.

In FIG. 7, a further insulating layer 22' of PFA is additionally arranged inside the insulation 22. By contrast, in FIG. 8, the conductor section 4' is surrounded by an additional conductor insulation 33 which is omitted at the conductor ends 16, however.

The cable cores 2 in FIGS. 7 and 8 are then preferably produced such that the conductor 4 is initially split up into a plurality of conductor sections 4' and an adapter element 19 is placed on each of the conductor ends 16 formed thereby. Subsequently, a long intermediate piece 18 is inserted into the respectively remaining end of an adapter element 19, the intermediate piece 18 then being arranged between the two conductor ends 16. The adapter element 19 is then in particular squeezed in order to fix the conductor end 16 respectively fitted therein and the intermediate piece 18. Subsequently, each particular adapter element 19 is encapsulated with PFA to form the joint 35. The entire arrangement is optionally surrounded by an insulating layer 22' of PFA along its length. Finally, the continuous insulating sheath 22 is applied. To this end, first of all simple or double taping with PTFE, which is subsequently sintered, is carried out; finally, an outermost layer of PFA is extruded on.

In order to produce a cable 36, a number of cable cores 2 are stranded together. An exemplary embodiment of such a cable 36 is illustrated schematically in cross section in FIG. 9. The cable 36 shown here contains three stranded-together part-cables 38. Each of the part-cables 38 contains six core bundles 42 stranded around a strain relief device 40. Each of these core bundles 42 in turn has eighteen cable cores 2 which are arranged around a strain relief device 44. In this case, the core bundle 42 has an internal layer 46 containing six cable cores 2 and an external layer 48 containing twelve cable cores 2. The internal layer 46, the external layer 48, the part-cable 38 and the entire cable 36 are preferably each surrounded by an additional sheath 50, which for example is extruded on or embodied as a taping.

In a variant embodiment, the internal layer 46 and/or the external layer 48 are configured in each case as a ribbon cable with six and twelve conductors 4, respectively, and are wrapped around the strain relief device 44 in the manner of a taping method. As a result, the manufacturing outlay for the core bundle 42 and thus in particular also for the entire cable 36 is reduced.

Figure 9:
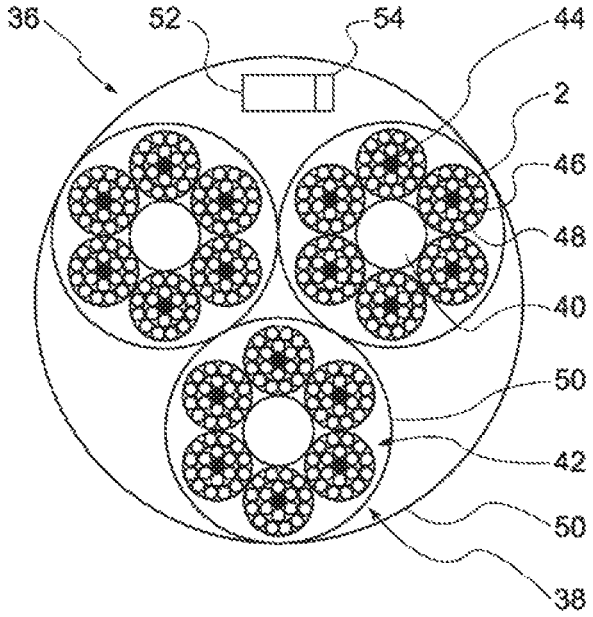
FIG. 9 is a cross sectional view showing a cable.

The cable 36 shown in FIG. 9 additionally has a sensor module 52 having a sensor 54. In order to generate an induction field, a current and a voltage are applied to each of the cable cores 2 at a predetermined frequency. The sensor 54 is then for example a Hall sensor, by which the sensor module 52 monitors the induction field. In an embodiment that is not shown here, a number of functional lines are provided in the cable 36, for example temperature sensors configured as optical fibers. These are then connected to one or more sensor modules 52.

Figure 10:
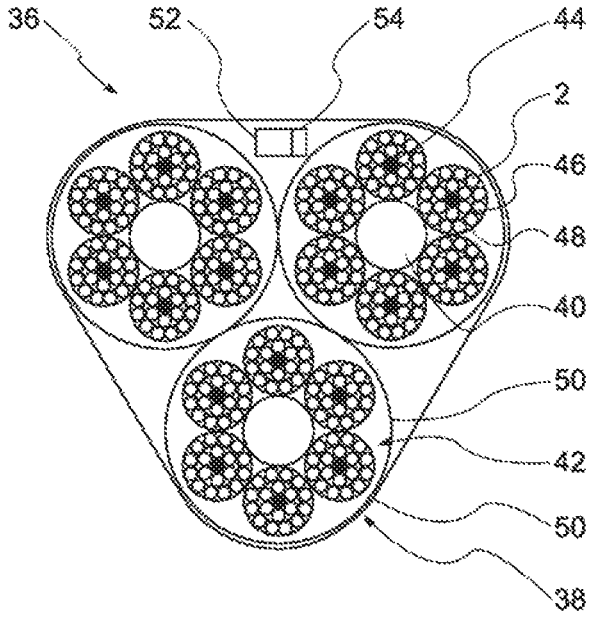
FIG. 10 is a cross sectional view showing an alternative embodiment of the cable according to FIG. 9.

An alternative configuration of the cable according to FIG. 9 is shown in FIG. 10. In this case, the outermost sheath 50 surrounding the three part-cables 38 is embodied as a taping. The resulting cross-sectional profile of the cable is as a result a triangle with rounded corners.

In the case of the cables 36 illustrated in FIGS. 9 and 10, the individual core bundles 42 are each formed as stranded elements with a 1-6-12 stranding of individual elements. The central strand is in this case configured as a strain relief device 44. The core bundle 42 produced in such a way has for example a diameter in the range of about 8 to 15 mm, in particular in the region of about 12 mm.

The individual part-cables 38 are in turn configured as a stranded assembly consisting of the central strain relief means 40 and six core bundles 42 stranded around the latter. In the exemplary embodiment, this stranded assembly is still surrounded, although it does not have to be, by a sheath which is configured for example as an injection-molded, extruded sheath 50 or as a taping for example by means of a polyester tape. This part-cable 38 preferably has a diameter in the region of a few centimeters, for example in the range of 2.5 to 6 cm, and in particular in the region of about 4 cm.

Expediently, a central strain relief core is additionally introduced, in a manner not illustrated in more detail, between the total of three part-cables 38.

The maximum width of the cable 36, i.e. in the case of FIG. 9 the diameter and in the case of the triangular configuration according to FIG. 10 a side length of the isosceles triangle, is in turn several centimeters, in particular about 6 to 12 cm and preferably about 8 cm. The three part-cables 38 are in turn stranded together. Both cable types according to FIGS. 9 and 10 are expediently also surrounded by a sheath 50 which is formed by an extrusion method. Expediently, it has a sheath thickness in the region of a few millimeters, in particular in the range of 2.5 to 5 mm.

The cable 36 formed has a length of preferably several 100 meters to a few kilometers.

The following is a summary list of reference numerals and the corresponding structure used in the above description of the invention:

2 Cable core
4 Conductor
4*a* Cavity
4' Conductor section
6 Longitudinal position
8 Intermediate space
10 Punching tool
12 Separation point
14 Section
16 Conductor end
18 Intermediate piece
18*a* Protrusion
18*b* Core
18*c* Sheathing
19 Adapter element
20 End face (intermediate piece)
21 End face (conductor)
22 Insulating sheath
22' Insulating layer
24 Lateral surface
26 Core end cap
28 Separation point
30 Head
32 Collar
33 Conductor insulation
34 Internal wall
35 Joint
36 Cable
38 Part-cable
40 Strain relief means (part-cable)
42 Core bundle
44 Strain relief means (core bundle)
46 Internal layer
48 External layer
50 Sheath
52 Sensor module
54 Sensor
A Spacing
D1 Diameter (insulating sheath)
D2 Diameter (conductor end)
D3 Diameter (core end cap)
D4 Diameter (conductor)
D5 Inside diameter
L1 Length
L2 Length (conductor end)
L3 Section length
R Longitudinal direction
S Punching direction
T Depth
Z Intermediate piece length

The invention claimed is:

1. A method for producing a cable core, which comprises:
providing a sheathless conductor separated in a recurring manner at predetermined longitudinal positions such that the conductor has an intermediate space and two conductor ends spaced apart by the intermediate space;
providing an insulating intermediate piece as a core end cap having an end with a recess formed therein;
introducing the insulating intermediate piece into the intermediate space;
fitting one of the two conductor ends of the conductor in the recess of the insulating intermediate piece; and
jointly providing the conductor and the insulating intermediate piece with a continuous insulating sheath to form the cable core.

2. The method according to claim 1, wherein:
the conductor is provided with a plurality of conductor sections separated from one another by the predetermined longitudinal positions such that each one of the conductor sections has a section length; and
the insulating intermediate piece is provided with an intermediate piece length being at least 0.5% and at most 4% of the section length.

3. The method according to claim 1:
wherein the insulating intermediate piece has an intermediate piece length that is at least 0.5% and at most 4% of 100 m.

4. The method according to claim 1, further comprising:
providing a sleeve-shaped adapter element, and providing the insulating intermediate piece with an intermediate piece length;
the two conductor ends being spaced apart by the intermediate piece length; and
connecting each of the two conductor ends to the insulating intermediate piece via the sleeve-shaped adapter element.

5. The method according to claim 1, wherein the insulating intermediate piece is configured as a flexible, tension-resistant element.

6. The method according to claim 1, wherein the insulating intermediate piece includes a tension-resistant core and an insulating sheathing which surrounds the tension-resistant core.

7. The method according to claim 1, further comprising:
providing an injection-molded joint; and
surrounding each of the conductor ends by the injection-molded joint which is in turn surrounded by the continuous insulating sheath.

8. The method according to claim 1,
wherein the continuous insulating sheath is configured with at least two layers having different materials that have different dielectric constants.

9. The method according to claim 8, wherein one of the at least two layers is produced from polytetrafluoroethylene (PTFE) and is sintered.

10. The method according to claim 1, wherein the cable core has a length extending in a longitudinal direction; and the insulating intermediate piece and the conductor are aligned in the longitudinal direction such that the cable core has a substantially identical diameter over the length of the cable core.

11. The method according to claim 1, wherein the recess is formed by a cylindrical and profiled internal wall.

12. The method according to claim 1, further comprising:

attaching an adapter element to each end of the insulating intermediate piece to form a prepared intermediate piece, the adapter element being a conductor piece similar or identical to the conductor used for the sheathless conductor; and attaching a respective one of the one of the two conductor ends to a respective adapter element.

13. The method according to claim 1, further comprising separating the conductor at the predetermined longitudinal positions such that a section having a particular length is separated out of the conductor.

14. The method according to claim 1, further comprising separating the intermediate piece into at least two subsections following a connection at a separation point.

15. The method according to claim 1, further comprising providing the conductor with a plurality of sheathless conductor sections and providing a plurality of intermediate pieces, each of the plurality of intermediate pieces separating two of the plurality of sheathless conductor sections from one another such that the plurality of sheathless conductor sections and the plurality of intermediate pieces form a continuous strand;

wherein the continuous insulating sheath is extruded directly onto the continuous strand consisting of the plurality of sheathless conductor sections and the plurality of intermediate pieces.

16. A method producing a cable, further comprising:

providing a plurality of cable cores, each of the plurality of cable cores manufactured by the method according to claim 1; and stranding the plurality of cable cores together to form the cable.

17. The method according to claim 16, wherein the step of stranding the plurality of cable cores together includes:

providing a plurality of core bundles, wherein each one of the plurality of core bundles is formed by stranding some of the plurality of cable cores together;

providing a plurality of part-cables, wherein each one of the plurality of part-cables is formed by stranding some of the plurality of core bundles together; and stranding the plurality of part-cables together to form the cable.

18. The method according to claim 16, further comprising disposing an insulating intermediate piece at each particular longitudinal position, the insulating intermediate piece having an intermediate piece length corresponding to at least 0.5% and at most 4% of a section length of 100 m.

19. The method according to claim 16, further comprising manufacturing the cable with a non-round cross-sectional area in a manner of a rounded triangle.

20. The method according to claim 16, further comprising combining the plurality of cable cores as a ribbon cable such that a plurality of conductors are disposed in a plane alongside one another and the continuous insulating sheath functions as a common, extruded insulating sheath.

* * * * *